US009746246B2

(12) United States Patent
Aust

(10) Patent No.: US 9,746,246 B2
(45) Date of Patent: Aug. 29, 2017

(54) PLATE HEAT EXCHANGER IN A SEALED DESIGN

(75) Inventor: Michael Aust, Nobitz/Niederleupten (DE)

(73) Assignee: GEA WTT GmbH, Nobitz-Wilchwitz (DE)

( * ) Notice: Subject to any disclaimer, the term of this patent is extended or adjusted under 35 U.S.C. 154(b) by 304 days.

(21) Appl. No.: 13/218,284

(22) Filed: Aug. 25, 2011

(65) Prior Publication Data

US 2012/0048510 A1 Mar. 1, 2012

(30) Foreign Application Priority Data

Aug. 25, 2010 (DE) ..... 10 2010 037 152

(51) Int. Cl.

| | |
|---|---|
| ***F28F 7/00*** | (2006.01) |
| ***F28F 9/00*** | (2006.01) |
| ***F28D 7/02*** | (2006.01) |
| ***F28F 3/08*** | (2006.01) |
| ***F28D 9/00*** | (2006.01) |

(52) U.S. Cl.

CPC ..... *F28D 9/005* (2013.01); *F28F 3/083* (2013.01); *F28F 9/001* (2013.01); *F28F 2275/127* (2013.01); *F28F 2275/20* (2013.01)

(58) Field of Classification Search

CPC F28D 9/0037; F28D 9/005; F28F 3/08; F28F 3/083; F28F 3/086; F28F 9/001; F28F 9/0075

USPC ..... 165/76, 78, 162, 164, 166, 167

See application file for complete search history.

(56) References Cited

U.S. PATENT DOCUMENTS

| | | | | |
|---|---|---|---|---|
| 157,566 | A * | 12/1874 | Bailey | 148/604 |
| 2,499,901 | A * | 3/1950 | Brown, Jr. | 165/160 |
| 2,877,756 | A * | 3/1959 | McCauley | F02F 7/006 123/195 C |
| 3,438,434 | A * | 4/1969 | Smith | 165/158 |

(Continued)

FOREIGN PATENT DOCUMENTS

| | | |
|---|---|---|
| DE | 20 118 511 | 3/2002 |
| DE | 10 2008 048 014 | 4/2010 |

(Continued)

OTHER PUBLICATIONS

Examination Report dated Jul. 29, 2014, issued by the State Intellectual Property Office of the People's Republic of China (translated to English language) for related Application No. 201110324439.X; 9 pages.

*Primary Examiner* — Henry Crenshaw

(74) *Attorney, Agent, or Firm* — Faegre Baker Daniels LLP

(57) ABSTRACT

The disclosure relates to a plate heat exchanger in a sealed design, with a stacked arrangement comprising a front-side and a rear-side end plate, wherein at least one end plate is constituted as a connection plate, heat exchanger plates which are arranged and stacked between the front-side and the rear-side end plate, in such a way that cavities for accommodating a plurality of heat exchanger media are formed between the heat exchanger plates, and sealing elements which are disposed to seal the cavities, and a clamping device, configured to exert an external clamping pressure on the stacked arrangement for the tensioning, wherein the clamping device is formed to encompass the stacked arrangement in a form-fit manner at least in sections, namely at least in a corner region of the stacked arrangement.

6 Claims, 4 Drawing Sheets

(56) References Cited

U.S. PATENT DOCUMENTS 3,810,509 A * 5/1974 Kun ..... 165/148
4,019,468 A * 4/1977 Miles ..... 122/510
4,036,289 A * 7/1977 Cheng et al. ..... 165/82
4,040,804 A * 8/1977 Harrison ..... 96/118
4,088,184 A * 5/1978 Cavallaro ..... 165/162
4,099,626 A * 7/1978 Magnussen, Jr. ..... 211/60.1
4,210,202 A * 7/1980 Boyer et al. ..... 165/162
4,252,578 A * 2/1981 Dumont et al. ..... 148/594
4,436,145 A * 3/1984 Manfredo et al. ..... 165/67
4,579,304 A * 4/1986 Williams ..... 248/68.1
4,595,161 A * 6/1986 Williams ..... 248/68.1
4,636,160 A * 1/1987 Nagasaka ..... 425/190
4,697,637 A * 10/1987 Young ..... 165/160
4,733,722 A * 3/1988 Forbes et al. ..... 165/159
4,818,135 A * 4/1989 Desjardins ..... 403/104
4,969,510 A * 11/1990 Greune ..... 165/76
5,110,074 A * 5/1992 Deguchi ..... 248/340
5,136,985 A * 8/1992 Krowech ..... 122/510
5,193,612 A * 3/1993 Stirnkorb ..... 165/167
5,435,383 A * 7/1995 Rajagopal ..... 165/167
5,484,131 A * 1/1996 Aldrete et al. ..... 248/527
5,562,150 A * 10/1996 Shimmell ..... B22D 17/145 164/305
5,634,658 A * 6/1997 Adams ..... B60R 21/217 280/728.2
5,789,091 A 8/1998 Wozniczka et al.
6,032,728 A * 3/2000 Ross et al. ..... 165/153
6,098,701 A 8/2000 Blomgren
6,131,649 A * 10/2000 Pearl et al. ..... 165/167
6,269,870 B1 * 8/2001 Banzhaf et al. ..... 165/158
6,290,192 B1 * 9/2001 Messerli ..... 248/188.5
7,080,864 B2 * 7/2006 Casteran ..... 294/67.3
7,234,511 B1 * 6/2007 Lesage ..... 165/69
7,320,178 B2 * 1/2008 Kirby et al. ..... 29/890.07
7,320,358 B2 * 1/2008 Kaspar et al. ..... 165/67
7,380,544 B2 * 6/2008 Raduenz et al. ..... 123/568.12
7,438,123 B2 * 10/2008 Tadokoro ..... 165/164
7,854,255 B2 * 12/2010 Nakamura ..... 165/166
8,033,323 B2 * 10/2011 Schatz et al. ..... 165/69
8,387,684 B2 * 3/2013 Capelle et al. ..... 165/69
2001/0035281 A1 * 11/2001 Fujita et al. ..... 165/104.12
2003/0056937 A1 * 3/2003 Muller et al. ..... 165/67
2003/0159805 A1 * 8/2003 Muhammad et al. ..... 165/76
2004/0069475 A1 * 4/2004 Brost et al. ..... 165/173
2004/0112579 A1 * 6/2004 Strahle ..... 165/166
2005/0103479 A1 * 5/2005 Richardson ..... 165/109.1
2005/0199227 A1 * 9/2005 Juschka et al. ..... 123/568.12
2005/0284620 A1 * 12/2005 Thunwall et al. ..... 165/167
2006/0093890 A1 5/2006 Steinbroner
2008/0110595 A1 * 5/2008 Palanchon ..... 165/103
2008/0251242 A1 * 10/2008 Irmler et al. ..... 165/164
2009/0211741 A1 * 8/2009 Pustelnik et al. ..... 165/167
2009/0218081 A1 * 9/2009 Mathew et al. ..... 165/162
2009/0277606 A1 * 11/2009 Reiss et al. ..... 165/69
2010/0159345 A1 6/2010 Shibata et al.
2010/0276131 A1 * 11/2010 Barwig et al. ..... 165/162
2011/0067837 A1 * 3/2011 Schatz et al. ..... 165/69
2013/0020062 A1 * 1/2013 Blomgren ..... 165/166

FOREIGN PATENT DOCUMENTS

GB 2151347 7/1985
JP 61083882 * 4/1986
JP 361083882 A * 4/1986 ..... F28D 9/02

* cited by examiner

PLATE HEAT EXCHANGER IN A SEALED DESIGN

CROSS REFERENCE TO RELATED APPLICATIONS

The present application relates to a plate heat exchanger in a sealed design, and is related to and claims priority to German Patent Application No. 10 2010 037 152.1, filed on Aug. 25, 2010, entitled PLATE HEAT EXCHANGER IN A SEALED DESIGN, and is hereby expressly incorporated into the present application by reference.

FIELD OF THE DISCLOSURE

The disclosure relates to a plate heat exchanger in a sealed design.

BACKGROUND OF THE DISCLOSURE

Plate heat exchangers are known in various designs. They include, in particular, sealed, soldered and welded plate heat exchangers. The various designs usually have in common the fact that a stacked arrangement is formed with a front-side and a rear-side end plate, between which a plurality of heat exchanger plates is accommodated and stacked, in such a way that cavities are formed between the heat exchanger plates, said cavities accommodating a plurality of heat exchanger media or fluids during operation. The heat exchanger media usually flow through the cavities.

Whereas sealing of the cavities takes place by means of soldered or welded joint in the case of the soldered or welded design, sealing elements are provided in the case of plate heat exchangers in a sealed design, said sealing elements being disposed in the stacked arrangement so as to seal the cavities. Sealed plate heat exchangers then comprise a clamping device, which is configured so as to pretension the stacked arrangement with end plates and heat exchanger plates as well as sealing elements, an external clamping pressure being exerted with the aid of the clamping device. FIG. 1 shows a perspective representation of a known plate heat exchanger in a sealed design, wherein a stack 3 with heat exchanger plates is disposed between two pressure frame plates 1, 2. The clamping device for pretensioning the stacked arrangement is formed by tension rods 4, which connect two end plates 1, 2 in overlapping regions 5. Tension rods 4 are provided with screw threads, so that an external pressure can be adjusted.

SUMMARY

An objective of the disclosure is to provide an improved plate heat exchanger in a sealed design, which can be produced more cost effectively and with an optimized design.

The disclosure comprises the idea of a plate heat exchanger in a sealed design with a stacked arrangement and a clamping device, which is configured to exert an external clamping pressure on the stacked arrangement for the tensioning, wherein the stacked arrangement comprises a front-side and a rear-side end plate, whereof at least one end plate is constituted as a connection plate, heat exchanger plates which are accommodated and stacked between the front-side and the rear-side end plate, in such a way that cavities for accommodating a plurality of heat exchanger media are formed between the heat exchanger plates, and sealing elements which are disposed to seal the cavities, and wherein the clamping device is constituted so as to encompass the stacked arrangement in a form-fit manner at least in sections, namely at least in a corner region of the stacked arrangement.

The cross-section of the clamping device on the inside, i.e. the side facing the stacked arrangement, is matched to the external contour of the stacked arrangement within the usual manufacturing tolerances in the at least one corner region. Provision can also be made such that the form-fitting is constituted in a plurality of or even all corner regions. The latter arises, for example, when the clamping device is formed completely encompassing the stacked arrangement in a form-fit manner.

In an illustrative embodiment of the disclosure it is envisaged that the clamping device rests essentially continuously on the external surface of an assigned section of the stacked arrangement in the at least one section of the stacked arrangement that is encompassed in a form-fit manner.

With the aid of the proposed plate heat exchanger, a heat exchanger is in the first place created which has a smaller size compared to the prior art, since it is not necessary to run tension rods laterally past the stacked heat exchanger plates in order to connect laterally projecting sections of the end plates for the clamping device. On the contrary, the clamping device encompasses the stacked arrangement in a form-fit manner at least in one corner region, so that a reduced space requirement or even no space requirement exists here at the side of the stacked arrangement, in particular for clamping elements.

In an illustrative embodiment of the disclosure it is provided that the clamping device is formed by one or a plurality of closed profile elements and/or one or a plurality of flexible tightening belts, which in each case encompass the stacked arrangement. The tightening belts are preferably made from a material from the group of the following materials: steel, plastics and thermoplastic materials. During the production of the plate heat exchanger, the one or the plurality of tightening belts are drawn up by means of mechanical tensioning and/or shrink-fitting on the stacked arrangement.

The one or the plurality of closed profile elements can for example be formed as a rectangular profile or tube. Profile elements in this or other embodiments are available as such at low cost in different variants. The production costs are thus minimised overall.

In the production of the plate heat exchanger, the one or the plurality of profile elements are pushed from the end face onto the stacked arrangement with end plates and heat exchanger plates disposed between the latter. This takes place with connections not yet assembled at least on one side. The connections can then be assembled after the pushing-on of the one or the plurality of closed profile elements.

An illustrative embodiment of the disclosure includes that the clamping device is formed by a continuous closed profile element, which extends over a region of at least 50% of the length of the section of the stacked arrangement between the connections on the connection plate thereby encompassing the stacked arrangement. In this embodiment, the continuous closed profile element forms a kind of "abdominal belt" in the region of the stacked arrangement between the connections. An embodiment makes provision such that the continuous closed profile element extends over a region of at least 75% of the length of the stacked arrangement between the connections. In an embodiment, the continuous closed profile element covers a length of at least 90% of the region between the connections. The section of the stacked arrangement between the connections can be encompassed wholly or partially by one or more closed profile elements.

In an illustrative embodiment of the disclosure it is provided that the clamping device is formed by a continuous closed profile element which extends over the whole length of the plate heat exchanger thereby encompassing the stacked arrangement.

In an illustrative embodiment of the disclosure, it is envisaged that the clamping device is formed by a plurality of closed profile elements, which all or at least in pairs have an essentially identical width in the longitudinal direction of the stacked arrangement.

In an advantageous embodiment of the disclosure it is provided that the one or the plurality of closed profile elements are formed from a standardised profile element. The use of standardised profile elements makes for a further cost reduction, since such profile elements are available at low cost as frequently produced products in different designs.

A development of the disclosure preferably provides wall sections of the one or the plurality of profile elements are formed as flat profiles. A flat design of the wall sections of the closed profile elements further makes for a minimised space requirement of the plate heat exchanger.

In an advantageous embodiment of the disclosure it is envisaged that the clamping device is formed by adjustable pretensioning elements, which are disposed on the one or the plurality of closed profile elements. The adjustable pretensioning elements are formed for example with the aid of screw elements, which are screwed into associated threaded sections in the one or the plurality of closed profile elements. The screw elements can then be screwed in until such time as they finally press against the stacked arrangement. Such screw elements are preferably provided on the closed profile elements only on the front side or only on the rear side of the stacked arrangement. On the opposite side, the stacked arrangement is then pressed in a two-dimensionally extending manner against the inner side of the closed profile element.

In a development of the disclosure it is provided that the adjustable pretensioning elements are configured to introduce the external clamping pressure on the stacked arrangement, preferably essentially in a centrally symmetric manner.

In an illustrative embodiment of the disclosure it is envisaged that the adjustable pretensioning elements are formed on one or all the closed profile elements spaced apart from one another in the transverse direction of the stacked arrangement.

In a development of the disclosure preferably it is provided that the one or the plurality of closed profile elements are formed leaving connection regions free, in which connections are disposed on the connection plate.

BRIEF DESCRIPTION OF THE DRAWINGS

The disclosure is explained in greater detail below in reference to the figures. In the figures.

DETAILED DESCRIPTION OF THE DRAWINGS

Figure 2:
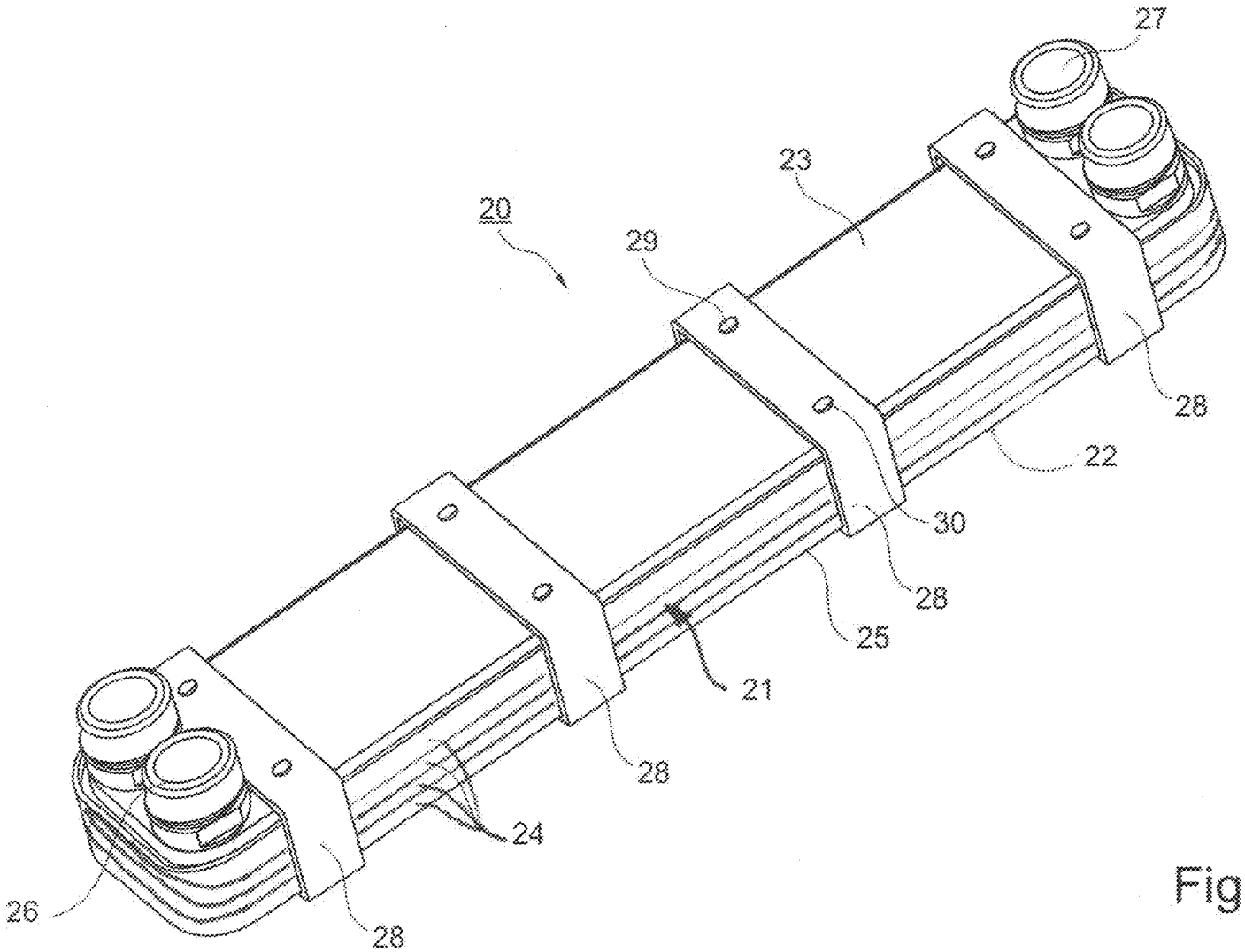
FIG. 2 shows a perspective view of a plate heat exchanger in a sealed design, wherein a clamping device is formed by a plurality of closed profile elements.

FIG. 2 shows a perspective view of a plate heat exchanger 20 in a sealed design, wherein stacked heat exchanger plates 24 are disposed in a stacked arrangement 21 between a front-side end plate 22 and a rear-side end plate 23, which is constituted as a connection plate. Stacked arrangement 21 is encompassed by a plurality of closed profile elements 28 in a region 25 between connections 26, 27. The plurality of closed profile elements 28 have an essentially uniform distance from one another. In other embodiments (not shown), it is envisaged that the section between connections 26, 27 is encompassed wholly or partially by a single closed profile element. Provision can also be made such that a plurality of closed profile elements jointly encompass essentially completely the region between connections 26, 27.

According to FIG. 2, there are provided on each of the plurality of closed profile elements 28 screws 29, 30 which are screwed into associated threaded sections, so that screws 29, 30 press against rear-side end plate 23, as a result of which a pretensioning is produced. In other embodiments (not shown), further screws can be provided in closed profile elements 28. In order to form the plurality of closed profile elements 28, use may be made of standardised profiles which preferably conform to the usual DIN standards.

Figure 5:
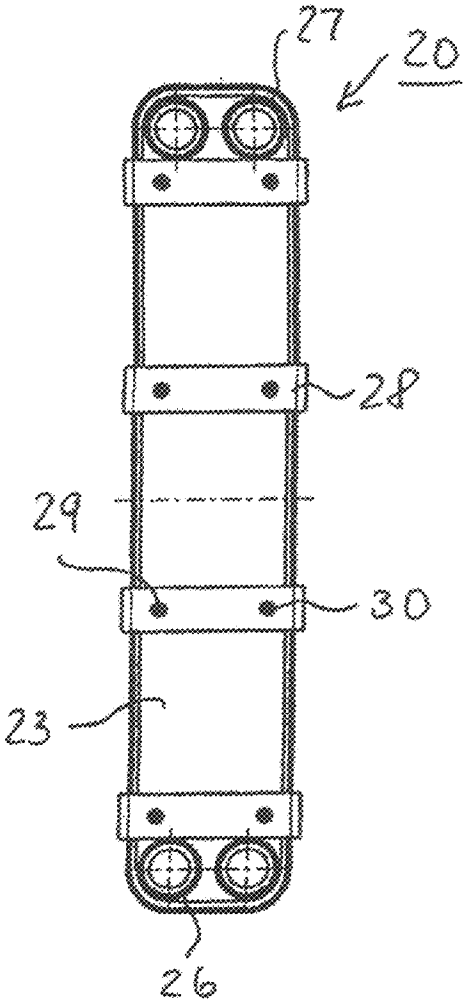
FIG. 5 shows a view of the plate heat exchanger from FIG. 2 from the rear.
Figure 4:
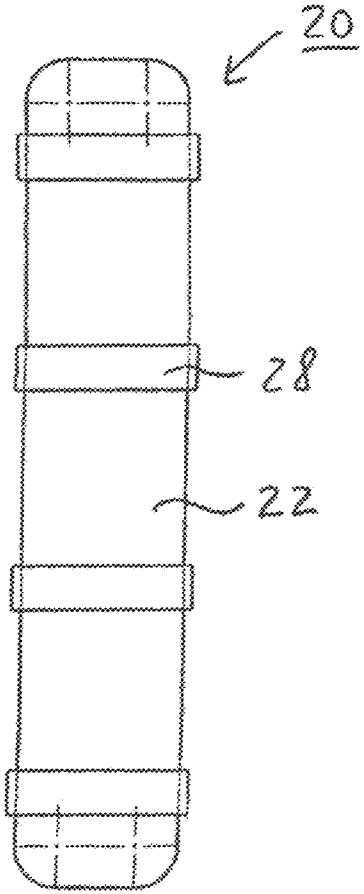
FIG. 4 shows a view of the plate heat exchanger from FIG. 2 from the front.
Figure 3:
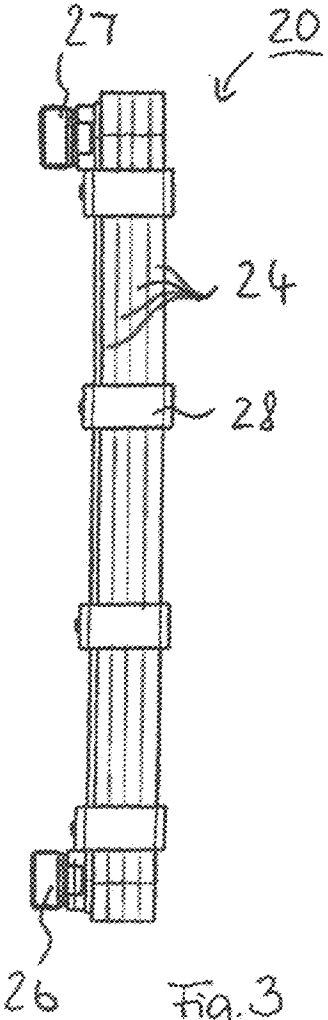
FIG. 3 shows a view of the plate heat exchanger from FIG. 2 from the side.

FIGS. 3 to 5 show a schematic view of plate heat exchanger 20 from FIG. 2 from the side, from the front and from the rear.

Figure 1:
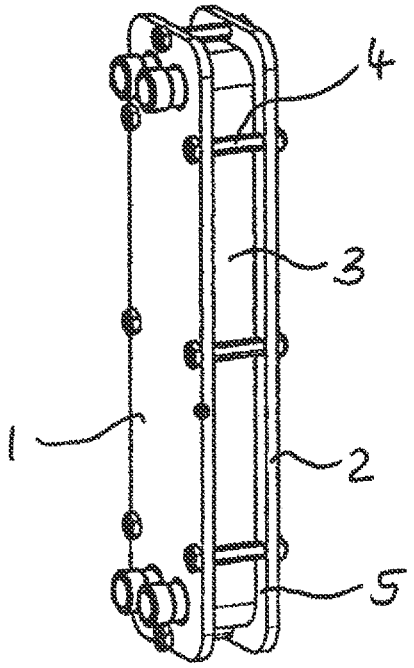
Fig. 1 (Prior Art)
FIG. 1 shows a perspective view of a plate heat exchanger in a sealed design according to the prior art.
Figure 6:
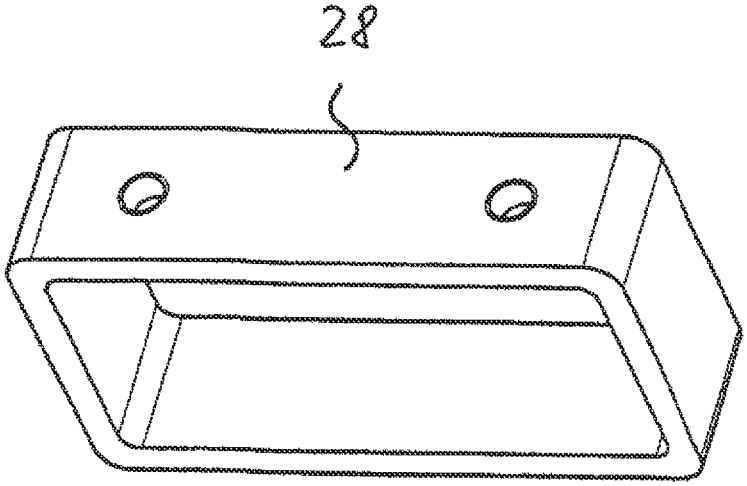
FIG. 6 shows a perspective view of a closed profile element of the clamping device with the plate heat exchanger in FIGS. 2 to 5 and FIG. 7 shows a perspective view of a plate heat exchanger in a sealed design, wherein a clamping device is formed by a continuous closed profile element over the whole length of the plate heat exchanger.

Finally, FIG. 6 shows a perspective view of closed profile elements 28 used in the plate heat exchanger in FIGS. 2 to 5.

Figure 7:
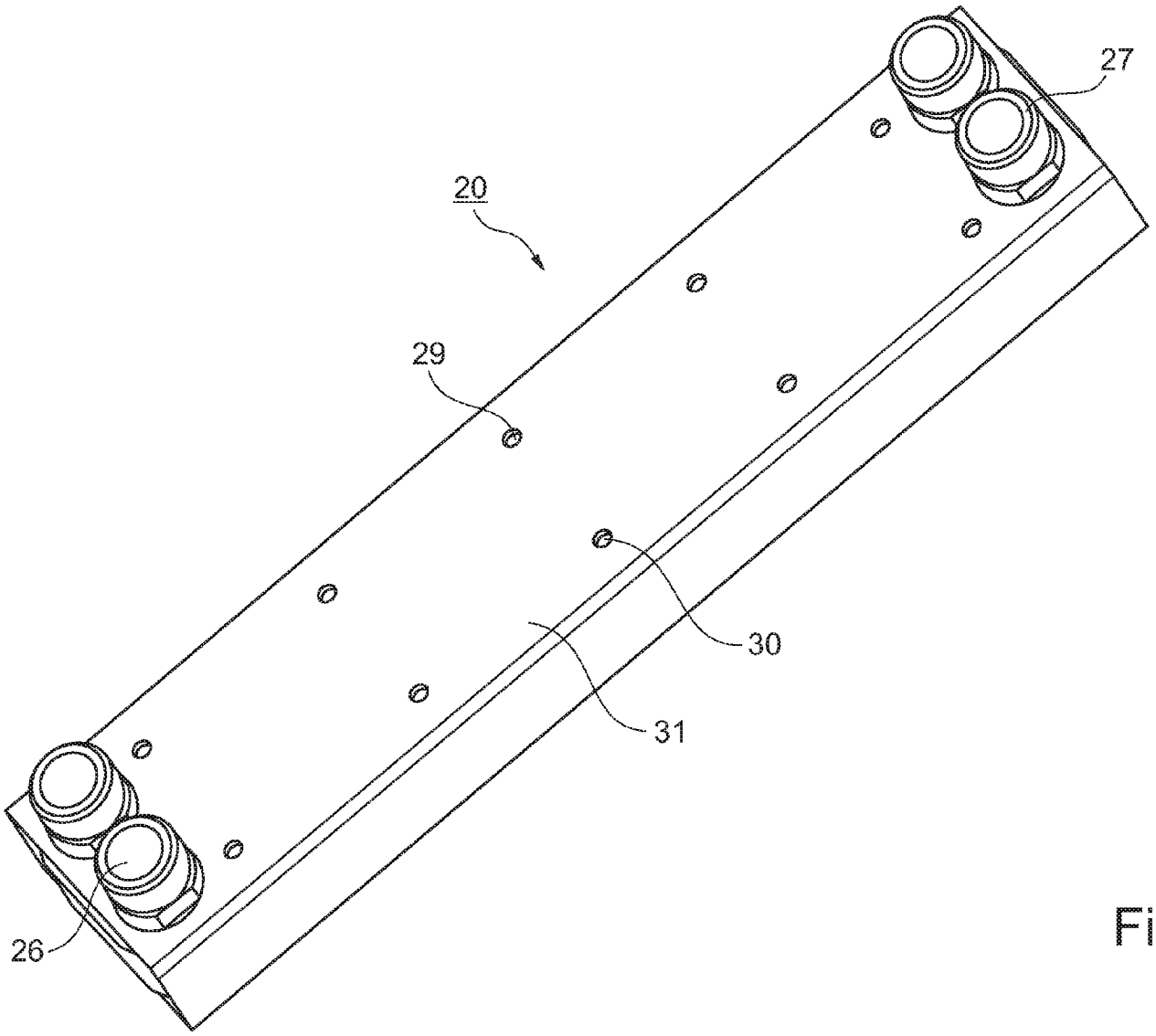

FIG. 7 shows a perspective view of a plate heat exchanger 20 in a sealed design, wherein a continuous closed profile element 31 extends over the whole length of plate heat exchanger 20.

The features of the disclosure disclosed in the above description, the claims and the figures can be of importance individually as well as in any combination for the realization of the disclosure in its various embodiments.

What is claimed is:

1. A plate heat exchanger in a sealed design, with:

a stacked arrangement comprising:

a front-side and a rear-side end plate, wherein at least one end plate is constituted as a connection plate having at least one connection, heat exchanger plates which are arranged and stacked between the front-side and the rear-side end plate, in such a way that cavities for accommodating a plurality of heat exchanger media are formed between the heat exchanger plates, and sealing elements which are disposed to seal the cavities, and a clamping device configured to exert an external clamping pressure on at least one of the front-side and the rear-side end plates of the stacked arrangement for tensioning, wherein the clamping device is formed to encompass the stacked arrangement in a form-fit manner at least in a corner region of the stacked arrangement and is formed with a plurality of one-piece closed profile elements having an inner surface that engages the stacked arrangement such that the inner surface rests continuously on an external surface of the corner region of the stacked arrangement and an outer surface that faces away from the stacked arrangement and adjustable pretensioning elements, which are disposed upon the outer surface and contact the stacked arrangement to adjust the external clamping pressure of the clamping device by adjusting the adjustable pretensioning elements; wherein at least one of the plurality of closed profile elements is arranged in contact with the at least one connection of the connection plate, wherein the plurality of closed profile elements includes at least one continuous closed profile element, which extends over a region of at least 50% of a length of a section of the stacked arrangement between connections on the connection plate thereby encompassing the stacked arrangement, and wherein wall sections of the plurality of profile elements are formed as flat profiles.

2. The plate heat exchanger according to claim 1, wherein the plurality of closed profile elements all or at least in pairs have an essentially identical width in the longitudinal direction of the stacked arrangement.

3. The plate heat exchanger according to claim 1, wherein the adjustable pretensioning elements are configured to introduce the external clamping pressure on the stacked arrangement.

4. The plate heat exchanger according to claim 1, wherein the adjustable pretensioning elements are formed on one or all the closed profile elements spaced apart from one another in the transverse direction of the stacked arrangement.

5. The plate heat exchanger according to claim 1, wherein the plurality of closed profile elements are formed leaving connection regions free, in which connections are disposed on the connection plate.

6. The plate heat exchanger according to claim 1, wherein the adjustable pretensioning elements are formed as screw elements, wherein the screw elements are screwed into associated threaded sections in the plurality of closed profile elements.

* * * * *